US006936576B2

(12) United States Patent
Ohsumi et al.

(10) Patent No.: US 6,936,576 B2
(45) Date of Patent: Aug. 30, 2005

(54) REFRIGERATING MACHINE OIL, AND FLUID COMPOSITION FOR REFRIGERATING MACHINE

(75) Inventors: Tomomasa Ohsumi, Yokohama (JP); Katsuya Takigawa, Yokohama (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 385 days.

(21) Appl. No.: 09/977,685

(22) Filed: Oct. 16, 2001

(65) Prior Publication Data

US 2002/0115577 A1 Aug. 22, 2002

(30) Foreign Application Priority Data

Oct. 17, 2000 (JP) ..... P2000-316821
Dec. 14, 2000 (JP) ..... P2000-380513

(51) Int. Cl.[7] ..... C10M 107/34; C09K 5/00; C07C 43/11

(52) U.S. Cl. ..... 508/579; 252/68; 568/613; 568/618; 568/619; 568/625

(58) Field of Search ..... 508/579

(56) References Cited

U.S. PATENT DOCUMENTS 4,948,525 A * 8/1990 Sasaki et al. ..... 508/304
5,279,752 A * 1/1994 Hasegawa et al. ..... 252/68
5,801,132 A * 9/1998 Kaneko et al. ..... 508/579
6,267,907 B1 * 7/2001 Tolfa et al. ..... 252/68
6,306,803 B1 * 10/2001 Tazaki ..... 508/539
6,335,311 B1 * 1/2002 Namiki et al. ..... 508/579
6,458,288 B1 * 10/2002 Kawaguchi et al. ..... 252/68
6,475,405 B1 * 11/2002 Kawaguchi et al. ..... 252/68
6,478,983 B1 * 11/2002 Matsuura et al. ..... 252/68
6,613,725 B1 * 9/2003 Tazaki ..... 508/579
6,656,891 B1 * 12/2003 Sakanoue et al. ..... 508/579

FOREIGN PATENT DOCUMENTS

| | | |
|---|---|---|
| DE | 299 14 502 | 12/1999 |
| EP | 1 063 279 | 12/2000 |
| EP | 1 085 077 | 3/2001 |
| JP | 10-46168 | 2/1998 |
| JP | 10-46169 | 2/1998 |
| JP | 2001-3072 | 1/2001 |
| JP | 2001-11480 | 1/2001 |
| JP | 2001-19989 | 1/2001 |
| JP | 2001-49282 | 2/2001 |
| JP | 2001-66004 | 3/2001 |
| WO | WO 98/50499 | 11/1998 |

* cited by examiner

*Primary Examiner*—Ellen M McAvoy
(74) *Attorney, Agent, or Firm*—Finnegan, Henderson, Farabow, Garrett & Dunner, LLP

(57) ABSTRACT

A refrigerating machine oil for a carbon dioxide refrigerant according to the invention is a refrigerating machine oil comprising polyalkylene glycol represented by the following general formula (1):

$$R^1\{-(OR^2)_n-OH\}_m \quad (1)$$

[where $R^1$ represents a residue of an organic compound having a hydroxyl group, from which the hydroxyl group has been removed, $R^2$ an alkylene group, and m and n respective integers], wherein a number average molecular weight of the polyalkylene glycol is not less than 500 nor more than 5000, wherein a rate of ethylene group among the alkylene group in the polyalkylene glycol is more than 0 and not more than 80 mol %, and wherein a rate of molecules in which the alkylene group bonded to a terminal hydroxyl group in the polyalkylene glycol is an ethylene group, is not more than 20 mol %.

3 Claims, 2 Drawing Sheets

REFRIGERATING MACHINE OIL, AND FLUID COMPOSITION FOR REFRIGERATING MACHINE

BACKGROUND OF THE INVENTION

1. Field of the Invention

The present invention relates to a refrigerating machine oil, and a fluid composition for refrigerating machines and, more particularly, to a refrigerating machine oil useful for carbon dioxide refrigerant refrigerators, and a fluid composition for such refrigerators.

2. Related Background Art

The recent problem of ozone layer destruction imposed limitations on use of CFCs (chlorofluorocarbons) and HCFCs (hydrochlorofluorocarbons), which have been used heretofore as refrigerants for refrigerator/air conditioner, and HFCs (hydrofluorocarbons) are being used as refrigerants instead of those restricted compounds. These HFC refrigerants, however, still involve problems of high global warming potential and others.

Thus use of natural refrigerants has been studied as substitute refrigerants for these fluorocarbon based refrigerants, and carbon dioxide ($CO_2$) was suggested as one of such natural refrigerants. Carbon dioxide has the advantage in safety of being safe for the environment and, though it was out of the mainstream of refrigerants, it has been used heretofore as a refrigerant for refrigerators and others and thus research is recently going on to apply it as a refrigerant used in automotive air conditioners, room air conditioners, heat pumps for hot water supply, etc. incorporating open type refrigerant compressors or hermetic, electric refrigerant compressors.

Incidentally, refrigerating/air conditioning equipment is normally provided with a refrigerant recirculating system consisting of a refrigerant compressor, a condenser (gas cooler), an expander, an evaporator, and so on, and in this refrigerant recirculating system the refrigerating machine oil, which is lubricating oil for the refrigerant compressor, circulates together with the refrigerant in cycles. Accordingly, the refrigerating machine oil needs to satisfy various property requirements including miscibility with refrigerant, fluidity at low temperatures, stability, etc., in addition to lubricity. However, these properties of refrigerating machine oil are readily affected by types of refrigerants, and the properties were not satisfactory in lubricity and stability when the fluorocarbon based refrigerant refrigerators commonly used heretofore were operated together with the $CO_2$ refrigerant.

Development has thus been made to develop novel refrigerating machine oils suitable for use along with the $CO_2$ refrigerant, and refrigerating machine oils using a variety of base oils have been proposed. For example, Japanese Patent Kokai (Laid-Open) Publication No. H10-46169 discloses the refrigerating machine oil using an ether compound, such as polyalkylene glycol (PAG), as a base oil.

SUMMARY OF THE INVENTION

Even in use of the above-stated conventional refrigerating machine oil as a refrigerating machine oil for the $CO_2$ refrigerant, however, there arose the problem that satisfactory stability was not achieved it water or oxygen was mixed in the refrigeration cycles. There was none developed yet as a refrigerating machine oil that fully satisfied all the performance requirements including the lubricity, miscibility with refrigerant, fluidity at low temperatures, stability, etc. in a good balance.

The present invention has been accomplished in view of the problems in the prior arts as described above and an object of the invention is to provide a refrigerating machine oil that can fully satisfy all the requirements of lubricity, miscibility with refrigerant, fluidity at low temperatures, and stability in a good balance in use along with the $CO_2$ refrigerant.

The inventors conducted diligent research aimed at achieving the above object and succeeded in completing the present invention on the basis of finding that the aforementioned problems were solved by using the refrigerating machine oil containing specific polyalkylene glycol among those considered to have a problem in stability heretofore.

Specifically, a refrigerating machine oil for a carbon dioxide refrigerant according to the present invention is a refrigerating machine oil comprising polyalkylene glycol represented by the following general formula (1)

$$R^1\{—(OR^2)_n—OH\}_m \quad (1)$$

[where $R^1$ represents a residue of an organic compound having one to ten hydroxyl groups, from which the hydroxyl groups have been removed, $R^2$ an alkylene group of 2 to 4 carbons, m an integer of 1 to 10, and n an integer of 1 to 100], wherein a number average molecular weight of said polyalkylene glycol is not less than 500 nor more than 5000, wherein a rate of ethylene group among said alkylene group in said polyalkylene glycol is more than 0 and not more than 80 mol %, and wherein a rate of molecules in which the alkylene group bonded to a terminal hydroxyl group in said polyalkylene glycol is an ethylene group, is not more than 20 mol %.

A fluid composition for a refrigerating machine according to the present invention comprises the above-stated refrigerating machine oil for the carbon dioxide refrigerant, and the carbon dioxide refrigerant.

In the present invention, a kinematic viscosity of said polyalkylene glycol at 100° C. is preferably 5–20 $mm^2/s$.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

The preferred embodiments of the present invention will be described below in detail.

A refrigerating machine oil for a carbon dioxide refrigerant according to the present invention is a refrigerating machine oil comprising polyalkylene glycol represented by the following general formula (1):

$$R^1\{-(OR^2)_n-OH\}_m \quad (1)$$

[where $R^1$ represents a residue of an organic compound having one to ten hydroxyl groups, from which the hydroxyl groups have been removed, $R^2$ an alkylene group of 2 to 4 carbons, m an integer of 1 to 10, and n an integer of 1 to 100], wherein a number average molecular weight of said polyalkylene glycol is not less than 500 nor more than 5000, wherein a rate of ethylene group among said alkylene group in said polyalkylene glycol is more than 0 and not more than 80 mol %, and wherein a rate of molecules in which the alkylene group bonded to a terminal hydroxyl group in said polyalkylene glycol is an ethylene group, is not more than 20 mol %; and, when used together with the carbon dioxide refrigerant, it can fully satisfy all the requirements of lubricity, miscibility with refrigerant, fluidity at low temperatures, and stability in a good balance.

It was very difficult heretofore to enhance both the lubricity and refrigerant miscibility well without damaging the stability, and the present inventors speculate that the following explains the reason why the refrigerating machine oil of the present invention fully satisfies all the aforementioned performance requirements in a good balance.

Figure 1:
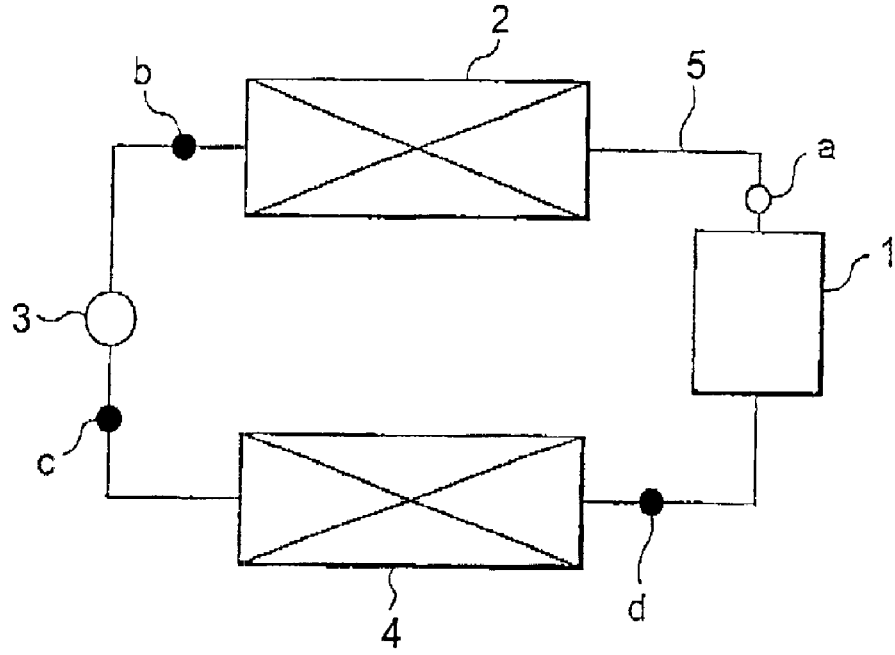
FIG. 1 is a schematic block diagram to show an example of a refrigerant circulating system.

The refrigerating/air conditioning equipment is normally provided, as shown in FIG. 1, with a refrigerant circulating system consisting of a refrigerant compressor 1, a gas cooler 2, an expander 3 (a capillary, an expansion valve, or the like), and an evaporator 4 successively connected by passage 5. In this refrigerate circulating system, first, the refrigerant at a high temperature (normally, 70 to 120° C.) is delivered from the refrigerant compressor 1 into the passage 5 and is then converted into a high-density fluid (supercritical fluid or the like) in the gas cooler 2. In subsequent steps, the refrigerant passes through a narrow passage inside the expander 3 to be liquefied, and is further evaporated to turn into the refrigerant at a low temperature (normally, −40 to 0° C.) in the evaporator 4.

Figure 2:
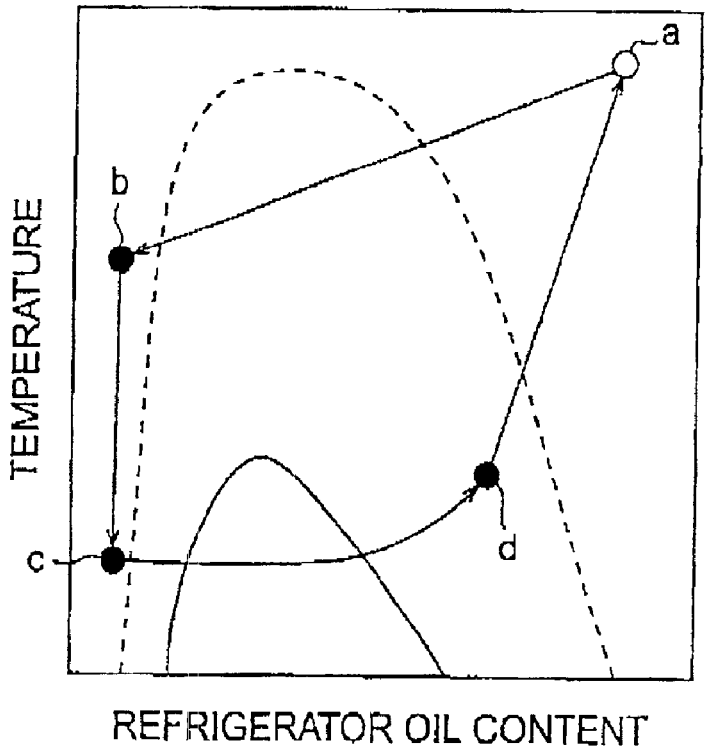
FIG. 2 is a graph showing a correlation between concentration of refrigerating machine oil and temperature of phase separation of mixture in refrigerant/refrigerating machine oil mixtures.

A mixed state of the mixture of the $CO_2$ refrigerant and the refrigerating machine oil (which will be referred to hereinafter simply as "mixture") circulating in the foregoing refrigerant recirculating system will be described below on the basis of FIG. 2. FIG. 2 is a graph to show an example of the correlation between concentration of the refrigerating machine oil in the mixture and temperature of phase separation. In FIG. 2, each of two curves indicates a lower limit of temperature where the refrigerant and the refrigerating machine oil are miscible with each other at a prescribed composition, wherein a solid line represents the refrigerating machine oil for the $CO_2$ refrigerant according to the present invention and a dashed line the conventional refrigerating machine oil for the $CO_2$ refrigerant. The region above each curve represents a miscible region and the region below each curve a immiscible region. In FIG. 2 points a to d indicate the relation between concentration and temperature of the refrigerating machine oil in the mixture at points a to d, respectively, in the passage in FIG. 1.

In the refrigerant compressor 1 in FIG. 1, a small amount of the $CO_2$ refrigerant and a large amount of the refrigerating machine oil coexist under the high-temperature (normally, 70 to 120° C.) condition. The refrigerant delivered from the refrigerant compressor 1 into the passage 5 is gaseous and contains a small amount (normally, 1 to 10%) refrigerating machine oil in the form of mist. A small amount of the refrigerant is dissolved in the refrigerating machine oil of this mist form (at point a in FIG. 2). In the gas cooler 2 the gaseous refrigerant is then compressed into the high-density fluid, in which a large amount of the refrigerant and a small amount of the refrigerating machine oil coexist under the relatively high temperature (normally, around 50 to 70° C.) condition (at point b in FIG. 2). Further, the mixture of the large amount of the refrigerant and the small amount of the refrigerating machine oil is successively delivered through the expander 3 and the evaporator 4 to be quickly cooled to the low temperature (normally, −40 to 0° C.) (at points c and d in FIG. 2), and is then returned again to the refrigerant compressor 1.

In such refrigeration cycles, it is desirable that the large amount of the refrigerant and the small amount of the refrigerating machine oil be in the miscible state throughout the entire temperature range (e.g., −40 to 120° C.) in the system. According to the research by the present inventors, however, under the high temperature condition, for example, as between points a–b in FIG. 2, the viscosity of the refrigerating machine oil becomes lower to enhance fluidity and the separate refrigerating machine oil is readily entrained in the stream of the refrigerant even in the immiscible state of the refrigerant and the refrigerating machine oil. Therefore, it is often the case that the oil return does not pose a problem even in the case of the conventional refrigerating machine oil for the $CO_2$ refrigerant. However, when most or the whole of the process under the low temperature condition (between points c–d in FIG. 2) where the mixture of the refrigerant and the refrigerating machine oil is delivered through the expander 3 to the evaporator 4, is carried out in the immiscible region (the region below the dashed line) as shown in FIG. 2, the refrigerating machine oil has a high viscosity under the low temperature condition and stays without being entrained in the stream of the refrigerant, so as to result in readily causing failure in lubrication of the refrigerant compressor or hindrance to heat exchange in the evaporator.

In contrast with it, the refrigerating machine oil for the $CO_2$ refrigerant according to the present invention demonstrates the miscibility with the $CO_2$ refrigerant in sufficiently wide composition ranges under the low temperature condition and, therefore, can sufficiently increase a rate of portions executed in the miscible region (the region above the solid line) among the process between points c and d in FIG. 2. A predetermined amount of the refrigerant is normally dissolved in the refrigerating machine oil even in the phase separated state of the refrigerant and the refrigerating machine oil to lower the viscosity of the refrigerating machine oil. The refrigerating machine oil for the $CO_2$ refrigerant according to the present invention has sufficiently high solubilities of $CO_2$ under the low temperature condition and the dissolved refrigerant decreases the viscosity of the refrigerating machine oil adequately. It becomes thus feasible to achieve sufficiently high oil return even if part of the process between points c and d in FIG. 2 is carried out in the immiscible region. Accordingly, it is feasible to adequately prevent the residence of the refrigerating machine oil in the expander and the evaporator and, in turn, prevent the resulting failure in lubrication of the refrigerant compressor and the resulting hindrance to heat exchange in the evaporator.

Japanese Patent Kokai (Laid-Open) Publication No. H10-46169 discloses the refrigerating machine oil for the $CO_2$ refrigerant containing polyalkylene glycol and describes that a predetermined amount of the $CO_2$ refrigerant is dissolved in the refrigerating machine oil, but fails to describe the temperature condition for dissolution of the $CO_2$ refrigerant in the refrigerating machine oil. According to the inventors' research based on the correlation between saturated vapor pressure and dissolved amount of the $CO_2$ refrigerant, the measurement results of dissolved amounts of the $CO_2$ refrigerant described in the foregoing Publication are those under the temperature condition of 15° C. or higher. As described later, the conventional refrigerating machine oil has narrow composition ranges for miscibility under the low temperature condition and provides only a weak viscosity lowing effect based on dissolution of the refrigerant in the immiscible region and it is thus very difficult to prevent the failure in lubrication of the refrigerant compressor and the hindrance to heat exchange in the evaporator by use of such refrigerating machine oil.

The polyalkylene glycol used in the present invention is one represented by the aforementioned general formula (1) and in Formula (1), $R^1$ represents the residue of the organic compound having one to ten hydroxyl groups, from which the hydroxyl groups have been removed. The organic compound having one to ten hydroxyl groups stated in the present invention encompasses monools such as monohydric alcohols and monohydric phenols, and polyols such as polyhydric alcohols with two to ten hydroxyl groups, polyhydric phenols, and saccharides.

Specific examples of the monools for the present invention include alcohols such as methanol, ethanol, propanol, 2-propanol, butanol, 2-butanol, pentanol, 2-pentanol, 3-pentanol, iso-pentyl alcohol, 2-methyl-4-pentanol, hexanol, secondary hexanol, iso-hexanol, heptanol, secondary heptanol, octanol, 2-ethylhexanol, secondary octanol, iso-octanol, nonanol, secondary nonanol, 1-decanol, iso-decyl alcohol, secondary decanol, undecanol, secondary undecanol, 2-methyldecanol, lauryl alcohol, secondary dodecanol, 1-tridecanol, iso-tridecyl alcohol, secondary tridecanol, myristyl alcohol, secondary tetradecanol, pentadecanol, secondary pentadecanol, cetyl alcohol, palmityl alcohol, secondary hexadecanol, heptadecanol, secondary heptadecanol, stearyl alcohol, iso-stearyl alcohol, secondary octadecyl alcohol, oleyl alcohol, behenyl alcohol, eicosanol, docosanol, tetracosanol, hexacosanol, octacosanol, myricil alcohol, laccerol, tetratriacontanol, allyl alcohol, cycropentanol, cycrohexanol, 2-butyloctanol, 2-butyldecanol, 2-hexyloctanol, 2-hexyldecanol, 2-hexyldodecanol, 2-octyldecanol, 2-octyldodecanol, 2-octyltetradecanol, 2-decyldodecanol, 2-decyltetradecanol, 2-decylhexadecanol, 2-dodecyltetradecanol, 2-dodecylhexadecanol, 2-dodecyloctadecanol, 2-tetradecyloctadecanol, 2-tetradecyleicosanol, 2-hexadecyloctadecanol, and 2-hexadecyleicosanol; and monohydric phenols such as phenol, cresol, ethylphenol, tertiary butylphenol, hexylphenol, octylphenol, nonylphenol, decylphenol undecylphenol dodecylphenol, tridecylphenol, tetradecylphenol, phenylphenol, benzylphenol, styrenated phenol, and p-cumylphenol.

Further, specific examples of the polyols for the present invention include dihydric alcohols such as ethylene glycol, propylene glycol, 1,4-butanediol, 1,2-butanediol, neopentyl glycol, 1,6-hexanediol, 1,2-octanediol, 1,8-octanediol, isoprene glycol, 3-methyl-1,5-pentanediol, sorbite, catechol, resorcin, hydroquinone, bisphenol A, bisphenol F, hydrogenated bisphenol A, hydrogenated bisphenol F, and dimerdiol; trihydric alcohols such as glycerol, 2-hydroxymethyl-1,3-propanediol, 1,2,3-butanetriol, 1,2,3-pentanetriol, 2-methyl-1,2,3-propanetriol, 2-methyl-2,3,4-butanetriol, 2-ethyl-1,2,3-butanetriol, 2,3,4-pentanetriol, 2,3,4-hexanetriol, 4-propyl-3,4,5-heptanetriol, 2,4-dimethyl-2,3,4-pentanetriol, 1,2,4-butanetriol, 1,2,4-pentanetriol, trimethylolethane, and trimethylolpropane; tetrahydric alcohols such as pentaerythritol, erythritol, 1,2,3,4-pentanetetrol, 2,3,4,5-hexanetetrol, 1,2,4,5-pentanetetrol, 1,3,4,5-hexanetetrol, diglycerol, and sorbitan; pentahydric alcohols such as adonitol, arabitol, xylitol, and triglycerol; hexahydric alcohols such as dipentaerythritol, sorbitol, mannitol, iditol, inositol, dulcitol, talose, and allose; octahydric alcohols such as sucrose; polyglycerols and dehydration condensates thereof; and so on.

In the foregoing general formula (1), m indicates a valence of $R^1$ (the number of hydroxyl groups in the aforementioned organic compound), which is an integer of 1 to 10 (preferably, an integer of 1 to 8, more preferably an integer of 1 to 3, and still more preferably 1). If m exceeds 10, the molecular weight of the resultant polyalkylene glycol will be too large, so as to result in too high viscosity or insufficient miscibility with the $CO_2$ refrigerant. When m is 1, i.e., when $R^1$ is a residue of a monool, the number of carbons in $R^1$ is preferably 1 to 10, more preferably 1 to 4, and still more preferably 1 (i.e., $R^1$ is a methyl group) from the standpoint of miscibility and fluidity at low temperatures; from the standpoint of lubricity, $R^1$ is preferably a straight or branched chain alkyl group of six to ten carbons and more preferably a straight or branched chain alkyl group of eight to ten carbons. When $R^1$ is an alkyl group and when the number of carbons thereof exceeds 10, the miscibility and the fluidity at low temperatures tends to be insufficient.

In the foregoing general formula (1), $R^2$ represents the alkylene group of two to four carbons, Specific examples of this alkylene group include the ethylene group ($—CH_2CH_2—$), the propylene group ($—CH(CH_3)CH_2—$), the trimethylene group ($—CH_2CH_2CH_2—$), the butylene group ($—CH(CH_2CH_3)CH_2—$), the tetramethylene group ($—CH_2CH_2CH_2CH_2—$), and so on. Among these alkylene groups, preferred groups are the ethylene group, the propylene group, the butylene group, and the tetramethylene group.

Further, in the foregoing general formula (1), n indicates a recurring number (degree of polymerization) of the alkylene group represented by $OR^2$, which is an integer of 1 to 100. The polyalkylene glycol according to the present invention is normally one obtained as a mixture of molecules of different recurring numbers n, and a number average molecular weight thereof needs to be not less than 500 nor more than 5000. If the number average molecular weight is less than the foregoing lower limit the hermetic sealability of the compressor will become insufficient. If the number average molecular weight exceeds the foregoing upper limit the miscibility of the refrigerating machine oil will become insufficient. For the same reasons, the number average molecular weight of the polyalkylene glycol according to the present invention is preferably not less than 600 nor more than 4000 and more preferably not less than 600 nor more than 3000. In the polyalkylene glycol according to the present invention, a ratio (Mw/Mn) of the weight average molecular weight (Mw) to the number average molecular weight (Mn) is preferably not less than 1.00 nor more than 1.20. If Mw/Mn exceeds 1.20, the miscibility between $CO_2$ and the refrigerating machine oil will tend to become insufficient.

Moreover, in the polyalkylene glycol according to the present invention, the rate of ethylene group to the alkylene group represented by $R^2$ in the foregoing general formula (1) (which will be referred to as $\alpha$) needs to be more than 0 and not more than 80 mol %. If the value of $\alpha$ is 0, the viscosity index will be too low to attain sufficient sealability and lubricity at high temperatures. If the value of $\alpha$ exceeds 80 mol % on the other hand, the refrigerating machine oil will become solid at the ordinary temperature or the pour point thereof will be too high to achieve sufficient fluidity at low temperatures. For the same reasons, $\alpha$ is preferably not less than 5 mol % nor more than 60 mol %, more preferably not less than 5 mol % nor more than 50 mol %, and still more preferably not less than 5 mol % nor more than 40 mol %.

As described above, the polyalkylene glycol according to the present invention has the ethylene group as the alkylene group represented by $R^2$ in the foregoing general formula (1), and in this polyalkylene glycol, the rate of molecules in which $R^2$ bonded to the terminal hydroxyl group is the ethylene group (which will be referred to hereinafter as $\beta$ [mol %]) needs to be not more than 20 mol %. If $\beta$ exceeds 20 mol % the polyalkylene glycol will become susceptible to oxidation, so that the refrigerating machine oil will fail to have satisfactory oxidation stability. For the same reason, $\beta$ is preferably not more than 10 mol % and more preferably not more than 5 mol %.

As described above, the polyoxyalkylene chain [$—(OR^2)_n—$] in the molecules of polyalkylene glycol according to the present invention comprises the oxyethylene group ($—OR^2—$ group where $R^2$ is the ethylene group) and the oxyalkylene group except for the oxyethylene group, and the polyoxyalkylene chain is preferably comprised of the oxyethylene group and the oxypropylene group. The polyoxyalkylene glycol having the polyoxyalkylene chain of this structure tends to demonstrate superior miscibility with $CO_2$. Further, in this case, a rate of the oxyethylene group in the polyoxyalkylene chain, i.e., $\gamma$ represented by the following formula:

$\gamma$[mol %]=(the number of oxyethylene groups/the sum of the number of oxyethylene groups and the number of oxypropylene groups)×100, is preferably more than 0 and not more than 80 mol %, more preferably not less than 5 mol % nor more than 60 mol %, still more preferably not less than 5 mol % nor more than 50 mol %, and yet more preferably not less than 5 mol % nor more than 40 mol %. When $\gamma$ is 0, the viscosity index tends to be too low to achieve sufficient sealability and lubricity at high temperatures. When $\gamma$ exceeds 80 mol %, the refrigerating machine oil using it is solid at the ordinary temperature, or the pour point thereof tends to be too high to achieve satisfactory fluidity at low temperatures.

The polyalkylene glycol according to the present invention can be synthesized by the conventionally known methods (cf. "Alkylene oxide polymers" Mitsuta Shibata et al., published Nov. 20, 1990, Kaibundo). For example, the polyalkylene glycol represented by the foregoing general formula (1) can be obtained by addition polymerization of ethylene oxide and one or more alkylene oxides except for ethylene oxide with a monohydric alcohol ($R^1OH$) as the organic compound having one to ten hydroxyl groups. Here the polyalkylene glycol according to the present invention can be either a random copolymer or a block copolymer, but it is preferably a block copolymer, because the polyalkylene glycol of the block copolymer tends to exhibit better oxidation stability. Further, when the polyalkylene glycol according to the present invention is a block copolymer, the block copolymer is preferably one wherein ethylene oxide polymerizes next to $R^1$ and one or more alkylene oxides except for ethylene oxide polymerize subsequent thereto. Among others, a particularly preferred block copolymer is one wherein ethylene oxide polymerizes next to $R^1$ and propylene oxide polymerizes subsequent thereto.

The pour point of the polyalkylene glycol having the above structure is preferably not more than −10° C. and more preferably −20 to −50° C. When the polyalkylene glycol has the pour point over −10° C., the refrigerating machine oil tends to be readily solidified at low temperatures in the refrigeration cycles.

The kinematic viscosity at 40° C. of the polyalkylene glycol according to the present invention is preferably not less than 10 $mm^2/s$ nor more than 1000 $mm^2/s$, more preferably not less than 20 $mm^2/s$ nor more than 600 $mm^2/s$, and still more preferably not less than 30 $mm^2/s$ nor more than 300 $mm^2/s$. When the kinematic viscosity at 40° C. is less than 10 $mm^2/s$, the lubricity and the hermitic sealability of the compressor tends to be insufficient. When the kinematic viscosity at 40° C. exceeds 1000 $mm^2/s$, the fluidity at low temperatures tends to be insufficient. The kinematic viscosity at 100° C. of the polyalkylene glycol is preferably not less than 3 $mm^2/s$ nor more than 180 $mm^2/s$, more preferably not less than 5 $mm^2/s$ nor more than 120 $mm^2/s$, and still more preferably not less than 7 $mm^2/s$ nor more than 70 $mm^2/s$. When the kinematic viscosity at 100° C. is less than 3 $mm^2/s$, the lubricity and the hermetic sealability of the compressor tends to be insufficient. When the kinematic viscosity at 100° C. exceeds 180 $mm^2/s$, the fluidity at low temperatures tends to be insufficient.

Further, from the viewpoint of oil return of the refrigerating machine oil in the refrigerant circulating system, the kinematic viscosity at 100° C. of the polyalkylene glycol represented by the foregoing general formula (1) is preferably 5–20 $mm^2/s$, more preferably 6–18 $mm^2/s$, still more preferably 7–16 $mm^2/s$, yet still more preferably 8–15 $mm^2/s$, and most preferably 10–15 $mm^2/s$. When the kinematic viscosity at 100° C. is less than 5 $mm^2/s$, the lubricity under coexistence of carbon dioxide tends to become lower. When the kinematic viscosity at 100° C. exceeds 20 $mm^2/s$ on the other hand, the composition ranges to demonstrate the miscibility with the $CO_2$ refrigerant under the low temperature condition tend to be narrowed, so as to readily cause the failure in lubricity of the refrigerant compressor and the hindrance to heat exchange in the evaporator. The kinematic viscosity at 40° C. of the polyalkylene glycol is preferably 10–200 $mm^2/s$ and more preferably 20–150 $mm^2/s$. When the kinematic viscosity at 40° C. is less than 10 $mm^2/s$, the lubricity and the hermetic sealability of the compressor tends to be degraded. When the kinematic viscosity at 40° C. exceeds 200 $mm^2/s$, the composition ranges demonstrating the miscibility with the $CO_2$ refrigerant under the low temperature condition tend to be narrowed, so as to readily cause the failure in lubricity of the refrigerant compressor and the hindrance to heat exchange in the evaporator.

In the refrigeration system, normally, the content of water mixed in the system needs to be kept as small as possible, and the moisture content in the refrigerating machine oil of the present invention is preferably not more than 500 ppm, more preferably not more than 200 ppm, and still more preferably not more than 100 ppm. In general, the polyglycol based oils have high hygroscopicity, and those having an ether group at one terminal and a hydroxyl group at the other terminal have higher hygroscopicity than those having ether groups at the both terminals. It is thus preferable to pay fine attention to the moisture content on the occasion of introducing the refrigerating machine oil into the system. On the other hand, however, under coexistence of polyalkylene glycol with higher hygroscopicity, mixed water is captured in molecules of polyalkylene glycol so as not to be freed, which presents the advantage of preventing ill effects including deterioration and freezing of the refrigerant and piping.

When the polyalkylene glycol according to the present invention contains an oxypropylene group, an allyl group might be formed in molecules through side reaction of propylene oxide during the production process. When the allyl group is formed in the polyalkylene glycol molecules, there readily occur the phenomena of degrading thermal stability of polyalkylene glycol itself, producing polymers to form sludge, and lowering antioxidation capability (oxidation preventing property) to produce peroxides. Particularly, if the peroxides are produced, they will decompose to produce compounds having the carbonyl group and the compounds having the carbonyl group will further react with the $CO_2$ refrigerant to produce acid amides, which will make clogging easy to occur in the capillary.

Accordingly, in the polyalkylene glycol according to the present invention, the degree of unsaturation originating in the allyl group and others is preferably as low as possible; specifically, it is preferably not more than 0.04 meq/g, more preferably not more than 0.03 meq/g, and most preferably not more than 0.02 meq/g.

The peroxide value of the polyalkylene glycol according to the present invention is preferably not more than 10.0 meq/kg, more preferably not more than 5.0 meq/kg, and most preferably 1.0 meq/kg.

Further, the carbonyl value of the polyalkylene glycol according to the present invention is preferably not more than 100 ppm by weight, more preferably not more than 50 ppm by weight, and most preferably not more than 20 ppm by weight.

The unsaturation degree, peroxide value, and carbonyl value stated in the present invention are values measured according to Standard Methods for the Analysis of Oil, Fats and Derivatives set by Japan Oil Chemists' Society. Namely, these are determined as follows: the unsaturation degree in the present invention is determined in such a way that a sample is reacted with the Wijs solution (ICl-acetic acid solution), the solution is kept at a dark place, thereafter excess ICl is reduced to iodine, the iodine is titrated with sodium thiosulfate to calculate an iodine value, this iodine value is converted to a vinyl equivalent, and this value of vinyl equivalent (meq/g) is referred to as the unsaturation degree;

the peroxide value stated in the present invention is determined in such a way that potassium iodide is added to a sample, free iodine produced is titrated with sodium thiosulfate, this free iodine is converted to a milliequivalent per kg of the sample, and this reduced value (meq/kg) is referred to as the peroxide value;

the carbonyl value stated in the present invention is determined in such a way that a sample is made to react with 2,4-dinitrophenylhydrazine to produce quinoid ions with coloring nature, absorbance of this sample is measured at 480 nm, the absorbance is converted to a carbonyl amount on the basis of a calibration curve preliminarily determined using cinnamaldehyde as a reference material, and the reduced value (ppm by weight) is referred to as the carbonyl value.

In the present invention, in order to obtain the polyalkylene glycol with low unsaturation degree, peroxide value, and carbonyl value, the reaction temperature during reaction of propylene oxide is preferably not more than 120° C. (more preferably, not more than 110° C.). If an alkali catalyst is used during the production, the unsaturation degree can be reduced by using an inorganic adsorbent, e.g., activated carbon, activated clay, bentonite, dolomite, aluminosilicate, or the like, in order to remove the alkali catalyst. It is also possible to prevent increase of the peroxide value or the carbonyl value by minimizing contact with oxygen or by using an antioxidant as well, during the production of the lubricant of the present invention or during use thereof.

In the refrigerating machine oil of the present invention, there are no specific restrictions on the content of the polyalkylene glycol represented by the foregoing general formula (1), but the content of the polyalkylene glycol is preferably not less than 50% by mass, based on the total amount of the refrigerating machine oil, more preferably not less than 70% by mass, still more preferably not less than 80% by mass, and most preferably not less than 90% by mass. When the content of the polyalkylene glycol according to the present invention is not less than 50% by mass, the refrigerating machine oil tends to improve the various properties more, including the lubricity, refrigerant miscibility, thermal and chemical stability, electric insulating property, and so on.

In addition to the polyalkylene glycol represented by the foregoing general formula (1), the refrigerating machine oil of the present invention may also include either selected from hydrocarbon based base oils such as mineral oils, olefin polymers, naphthalene compounds, alkylbenzene, and the like; oxygen-containing synthetic oils such as esters, ketones, polyphenyl ethers, silicones, polysiloxanes, perfluoroethers, polyvinyl ethers, and polyglycols except for the polyalkylene glycol according to the present invention, and so on. Among these compounds, the oxygen-containing synthetic oils preferably used are the polyvinyl ethers, and the polyglycols except for the polyalkylene glycol according to the present invention.

In the refrigerating machine oil of the present invention, the polyalkylene glycol represented by the foregoing general formula (1), and the hydrocarbon based oil and/or the oxygen-containing synthetic oil, which is used together with the polyalkylene glycol as occasion may demand, are mainly used as base oils. The refrigerating machine oil of the present invention can be suitably used without addition of any additive, but it can also be used with addition of various additives described below as occasion may demand.

For further enhancement of the abrasion resistance and load resistance of the refrigerating machine oil composition of the invention, it may incorporate at least one type of phosphorus compound selected from the group consisting of phosphoric acid esters, acidic phosphoric acid esters, amine salts of acidic phosphoric acid esters, chlorinated phosphoric acid esters, and phosphorous acid esters. These phosphorus compounds are esters of phosphoric acid or phosphorous acid with alkanols or polyether alcohols, or derivatives thereof. As specific examples of the phosphoric acid esters there may be mentioned tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenyl phosphate, and xylenyldiphenyl phosphate;

as specific examples of the acidic phosphoric acid esters there may be mentioned monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate, and dioleyl acid phosphate;

as specific examples of the amine salts of acidic phosphoric acid esters there may be mentioned salts of the above acidic phosphoric acid esters with amines such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine, and trioctylamine;

as specific examples of the chlorinated phosphoric acid esters there may be mentioned tris dichloropropyl phosphate, tris chloroethyl phosphate, tris chlorophenyl phosphate, and polyoxyalkylene bis[di(chloroalkyl)] phosphate; and as specific examples of the phosphorous acid esters there may be mentioned dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite, and tricresyl phosphite. These phosphorus compounds may be used singly or in combination of two or more kinds.

When the above-stated phosphorus compounds are added to the refrigerating machine oil composition of the invention, there are no particular restrictions on their content, but it is normally desirable to add the phosphorus compounds in such an amount that the content thereof is 0.01 to 5.0% by mass and more preferably 0.02 to 3.0% by mass, based on the total amount of the refrigerating machine oil composition (i.e., based on the total amount of the base oil and all additives incorporated).

In addition, for further improvement in heat and hydrolytic stability of the refrigerating machine oil composition of the invention, the composition may also include at least one epoxy compound selected from the group consisting of the following (i) to (viii):

(i) phenylglycidyl ether epoxy compounds
(ii) alkylglycidyl ether epoxy compounds
(iii) glycidyl ester epoxy compounds
(iv) allyloxirane compounds
(v) alkyloxirane compounds
(vi) alicyclic epoxy compounds
(vii) epoxidized fatty acid monoesters
(viii) epoxidized vegetable oils Specific examples of (i) phenylglycidyl ether epoxy compounds include phenylglycidyl ethers and alkylphenylglycidyl ethers. Here, the alkylphenylglycidyl ethers may have 1–3 alkyl groups of 1–13 carbons, among which preferred examples include those with one alkyl group of 4–10 carbons, such as n-butylphenylglycidyl ether, i-butylphenylglycidyl ether, sec-butylphenylglycidyl ether, tert-butylphenylglycidyl ether, pentylphenylglycidyl ether, hexylphenylglycidyl ether, heptylphenylglycidyl ether, octylphenylglycidyl ether, nonylphenylglycidyl ether, and decylphenylglycidyl ether.

Specific examples of (ii) alkylglycidyl ether epoxy compounds include decylglycidyl ether, undecylglycidyl ether, dodecylglycidyl ether, tridecylglycidyl ether, tetradecylglycidyl ether, 2-ethylhexylglycidyl ether, neopentylglycoldiglycidyl ether, trimethylolpropane triglycidyl ether, pentaerythritol tetraglycidyl ether, 1,6-hexanediol diglycidyl ether, sorbitolpolyglycidyl ether, polyalkyleneglycol monoglycidyl ether, and polyalkyleneglycol diglycidyl ether.

Specific example of (iii) glycidyl ester epoxy compounds include compounds represented by the following general formula (2):

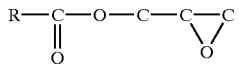

(2)

where R represents a hydrocarbon group of 1–18 carbons.

In formula (2) above, R represents a hydrocarbon group of 1–18 carbons, and as such hydrocarbon groups there may be mentioned alkyl groups of 1–18 carbons, alkenyl groups of 2–18 carbons, cycloalkyl groups of 5–7 carbons, alkylcycloalkyl groups of 6–18 carbons, aryl groups of 6–10 carbons, alkylaryl groups of 7–18 carbons and arylalkyl groups of 7–18 carbons. Preferred among these are alkyl groups of 5–15 carbons, alkenyl groups of 2–15 carbons, phenyl groups and alkylphenyl groups with alkyl groups of 1–4 carbons.

Specific preferred examples among these glycidyl ester epoxy compounds include glycidyl-2,2-dimethyl octanoate, glycidyl benzoate, glycidyl-tert-butyl benzoate, glycidyl acrylate, glycidyl methacrylate, and the like.

Specific examples of (iv) allyloxirane compounds include 1,2-epoxystyrene and alkyl-1,2-epoxystyrene.

Specific examples of (v) alkyloxirane compounds include 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,1,2-epoxyoctadecane, 2-epoxynonadecane and 1,2-epoxyeicosane.

As (vi) alicyclic epoxy compounds there may be mentioned compounds wherein carbon atoms composing the epoxy group are directly part of the alicycle, such as compounds represented by the following general formula (3);

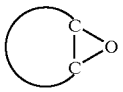

(3)

Specific examples of such alicyclic epoxy compounds include 1,2-epoxycyclohexane, 1,2-epoxycyclopentane, 3,4-epoxycyclohexylmethyl-3,4-epoxycyclohexane carboxylate, bis(3,4-epoxycyclohexylmethyl) adipate, exo-2,3-epoxynorbornane, bis(3,4-epoxy-6-methylcyclohexylmethyl) adipate, 2-(7-oxabicyclo[4.1.0]hept-3-yl)-spiro(1,3-dioxane-5,3'-[7]oxabicyclo[4,1.0]heptane, 4-(1'-methylepoxyethyl)-1,2-epoxy-2-methylcyclohexane, and 4-epoxyethyl-1,2-epoxycyclohexane.

Specific examples of (vii) epoxidized fatty acid monoesters include esters of epoxidized fatty acids of 12–20 carbons and alcohols of 1–8 carbons, phenols or alkylphenols. Particularly preferred for use are butyl, hexyl, benzyl, cyclohexyl, methoxyethyl, octyl, phenyl, and butylphenyl esters of epoxystearic acid.

Specific examples of (viii) epoxidized vegetable oils include epoxy compounds of vegetable oils such as soybean oil, linseed oil, and cottonseed oil.

Among the aforementioned epoxy compounds, phenylglycidyl ether epoxy compounds, glycidyl ester epoxy compounds, alicyclic epoxy compounds and epoxidized fatty acid monoesters are preferred for further improved heat and hydrolytic stability, with glycidyl ester epoxy compounds and alicyclic epoxy compounds being even more preferred.

When these epoxy compounds are incorporated in the refrigerant oil composition according to the invention, there are no particular restrictions on their addition content but the epoxy compound is usually added to a content of 0.1–5.0% by mass and more preferably 0.2–2.0% by mass, based on the total amount of the refrigerating machine oil composition (the total amount of the base oil and all incorporated additives).

Two or more different types of the aforementioned phosphorus compounds and epoxy compounds may, of course, be used in combination.

In order to further improve the performance, the refrigerating machine oil composition of the invention may be incorporated, as required, with hitherto publicly known additives for refrigerating machine oils, for example, phenol-type antioxidants such as di-tert-butyl-p-cresol and bisphenol A; amine-type antioxidants such as phenyl-α-naphthylamine and N,N-di(2-naphthyl)-p-phenylenediamine; wear resistance agents such as zinc dithiophosphate; extreme pressure agents such as chlorinated paraffin and sulfur compounds; oiliness improvers such as fatty acids; antifoaming agents such as silicone types; metal inactivators such as benzotriazole; viscosity index improvers; pour-point depressants; detergent dispersants and the like, either alone or in combination of more than one type. The total amount of the additives added into the refrigerating machine oil is not particularly limited, but the content is preferably not more than 10% by mass and more preferably not more than 5% by mass, based on the total amount of the refrigerating machine oil composition (i.e., the total amount of the base oil and all incorporated additives).

There are no specific restrictions on the kinematic viscosity of the refrigerating machine oil of the present invention, but the kinematic viscosity at 40° C. of the refrigerating machine oil is preferably not less than 10 $mm^2/s$ nor more than 200 $mm^2/s$ and more preferably not less than 20 $mm^2/s$ nor more than 150 $mm^2/s$. When the kinematic viscosity at 40° C. is less than 10 $mm^2/s$, the lubricity and the hermetic sealability of the compressor tends to be insufficient. When the kinematic viscosity at 40° C. exceeds 200 $mm^2/s$, the miscibility with carbon dioxide tends to be insufficient. The kinematic viscosity at 100° C. of the aforementioned refrigerating machine oil is preferably not less than 3 $mm^2/s$ nor more than 30 $mm^2/s$ and more preferably not less than 5 $mm^2/s$ nor more than 25 $mm^2/s$. When the kinematic viscosity at 100° C. is less than 3 $mm^2/s$, the lubricity and the hermetic sealability of the compressor tends to be insufficient. When the kinematic viscosity at 100° C. exceeds 30 $mm^2/s$, the miscibility with carbon dioxide tends to be insufficient.

Further, from the viewpoint of oil return of the refrigerating machine oil in the refrigerant circulating system, the kinematic viscosity at 100° C. of the refrigerating machine oil for the $CO_2$ refrigerant according to the present invention is preferably 5 to 20 $mm^2/s$, more preferably 6 to 18 $mm^2/s$, still more preferably 7 to 16 $mm^2/s$, yet still more preferably 8 to 15 $mm^2/s$, and most preferably 10 to 15 $mm^2/s$. When the kinematic viscosity at 100° C. is less than 5 $mm^2/s$, the lubricity tends to be degraded under coexistence of $CO_2$. On the other hand, when the kinematic viscosity at 100° C. exceeds 20 $mm^2/s$, the composition ranges demonstrating the miscibility with the $CO_2$ refrigerant under the low temperature condition tend to be narrowed, so as to readily cause the failure in lubricity of the refrigerant compressor and the hindrance to heat exchange in the evaporator. The kinematic viscosity at 40° C. of the foregoing refrigerating machine oil is preferably 10 to 200 $mm^2/s$ and more preferably 20 to 150 $mm^2/s$. When the kinematic viscosity at 40° C. is less than 10 $mm^2/s$, the lubricity and the hermetic sealability of the compressor tends to be degraded. When the kinematic viscosity at 40° C. exceeds 200 $mm^2/s$, the composition ranges demonstrating the miscibility with the $CO_2$ refrigerant under the low temperature condition tend to be narrowed, so as to readily cause the failure in lubricity of the refrigerant compressor and the hindrance to heat exchange in the evaporator.

The refrigerating machine oil for the $CO_2$ refrigerant according to the present invention, having the above structure, is used as a fluid composition of mixture with the $CO_2$ refrigerant in the refrigerating machines for the $CO_2$ refrigerant. Namely, the refrigerator fluid composition of the present invention contains the foregoing refrigerating machine oil for the $CO_2$ refrigerant according to the present invention, and the $CO_2$ refrigerant. There are no specific restrictions on a blending ratio of the refrigerating machine oil and the refrigerant in the refrigerator fluid composition of the present invention, but the blending ratio of the refrigerating machine oil to 100 parts by weight of the refrigerant is preferably 1 to 500 parts by weight and more preferably 2 to 400 parts by weight.

The refrigerator fluid composition of the present invention contains the $CO_2$ refrigerant as described above, but may further contain another refrigerant, e.g., hydrofluorocarbon (HFC), hydrocarbon, ammonia, and so on.

As hydrofluorocarbon refrigerants for the invention there may be mentioned those having 1–3 and preferably 1 or 2 carbon atoms. Specific examples include difluoromethane (HFC-32), trifluoromethane (HFC-23), pentafluoroethane (HFC-125), 1,1,2,2-tetrafluoroethane (HFC-134), 1,1,1,2-tetrafluoroethane (HFC-134a), 1,1,1-trifluoroethane (HFC-143a), 1,1,-difluoroethane (HFC-152a), and mixtures of two or more kinds of them. The refrigerant is optionally selected in accordance with the intended use and the required performance, and as preferred examples there may be mentioned HFC-32 alone; HFC-23 alone; HFC-134a alone; HFC-125 alone; a mixture of HFC-134a/HFC-32=60–80% by mass/40–20% by mass; a mixture of HFC-32/HFC-125=40–70% by mass/60–30% by mass; a mixture of HFC-125/HFC-143a=40–60% by mass/60–40% by mass; a mixture of HFC-134a/HFC-32/HFC-125=60% by mass/30% by mass/10% by mass; a mixture of HFC-134a/HFC-32/HFC-125=40–70% by mass/15–35% by mass/5–40% by mass; and a mixture of HFC-125/HFC-134a/HFC-143a=35–55% by mass/1–15% by mass/40–60% by mass. More specific examples include a mixture of HFC-134a/HFC-32=70/30% by mass; a mixture of HFC-32/HFC-125=60/40% by mass; a mixture of HFC-32/HFC-125=50/50% by mass (R410A); a mixture of HFC-32/HFC-125=45%/55% by mass (R410B); a mixture of HFC-125/HFC-143a=50/50% by mass (R507C); a mixture of HFC-32/HFC-125/HFC-134a=

30/10/60% by mass; a mixture of HFC-32/HFC-125/HFC-134a=23/25/52% by mass (R407); a mixture of HFC-32/HFC-125/HFC-134a=25/15/60% by mass (R407E); and a mixture of HFC-125/HFC-134a/HFC-143a=44/4/52% by mass (R404A).

The hydrocarbon refrigerants for the invention are preferably gas at 25° C. under 1 atm. Specifically, they include alkanes, cycloalkanes, and alkenes of 1 to 5 carbons and preferably 1 to 4 carbons, and mixtures thereof. Specific examples of such hydrocarbon refrigerants include methane, ethylene, ethane, propylene, propane, cyclopropane, butane, isobutane, cyclobutane, methylcyclopropane, and mixtures of two or more of these compounds. Propane, butane, isobutane, and mixtures of at least two kinds are preferred among these.

There are no specific limitations to the mixing ratio of carbon dioxide and hydrofluorocarbon and/or hydrocarbon, but the total amount of hydrofluorocarbon and hydrocarbon to 100 parts by weight of carbon dioxide is preferably 1 to 200 parts by weight and more preferably 10 to 100 parts by weight.

The refrigerating machine oil of the present invention fully satisfies all the performance requirements of the lubricity, refrigerant miscibility, low-temperature fluidity, stability, etc. in a good balance and can be suitably applied to the refrigerating equipment or heat pumps having the reciprocating or rotary, open or hermetic compressors. The foregoing refrigerating equipment, more specifically, includes automotive air conditioners, dehumidifiers, freezers, freeze and refrigeration warehouses, automatic vending machines, showcases, cooling apparatus in chemical plants, air conditioners for residential use, heat pumps for hot-water supply, and so on.

EXAMPLES

The details of the present invention will be described more specifically with examples and Comparative examples, but it is noted that the present invention is by no means intended to be limited to these examples.

Examples 1 to 8 and Comparative Examples 1 to 4

In Examples 1 to 8 and Comparative Examples 1 to 4, respective base oils 1 to 12 described below were used as sample oils. In the structural formulas of the base oils 1 to 10, Et represents the ethylene group and Pr the propylene group.

Base Oil 1:

$$C_4H_9—(OEt)_{n'}—(OPr)_{n''}—OH$$

[ethylene oxide-propylene oxide block copolymer having a butyl group at one end and a hydroxyl group at the other end, number average molecular weight: 600, $M_w/M_n$: 1.1, α=50 [mol %], β<5 [mol %] γ=50 [mol %]]

Base Oil 2:

$$CH_3—(OEt)_{n'}—(OPr)_{n''}—OH$$

[ethylene oxide-propylene oxide block copolymer having a methyl group at one end and a hydroxyl group at the other end,
number average molecular weight: 600, $M_w/M_n$; 1.1, α=10 [mol %], β<5 [mol %], γ=10 [mol %]]

Base Oil 3:

$$CH_3—(OEt)_{n'}—(OPr)_{n''}—OH$$

[ethylene oxide-propylene oxide block copolymer having a methyl group at one end and a hydroxyl group at the other end,
number average molecular weight: 1200, $M_w/M_n$: 1.1, α=10 [mol %], β<5 [mol %], γ=10 [mol %]]

Base Oil 4:

$$CH_3—(OEt)_{n'}—(OPr)_{n''}—OH$$

[ethylene oxide-propylene oxide block copolymer having a methyl group at one end and a hydroxyl group at the other end,
number average molecular weight: 1200, $M_w/M_n$; 1.1, α=20 [mol %], β<5 [mol %], γ=20 [mol %]]

Base Oil 5:

$$C_4H_9—(OEt)_{n'}—(OPr)_{n''}—OH$$

[ethylene oxide-propylene oxide block copolymer having a butyl group at one end and a hydroxyl group at the other end,
number average molecular weight: 1200, $M_w/M_n$: 1.1, α=50 [mol %], β<5 [mol %], γ=50 [mol %]]

Base Oil 6:

$$CH_3—(OEt)_{n'}—(OPr)_{n''}—OH$$

[ethylene oxide-propylene oxide block copolymer having a methyl group at one end and a hydroxyl group at the other end,
number average molecular weight: 1800, $M_w/M_n$: 1.1, α=40 [mol %], β<5 [mol %], γ=40 [mol %]]

Base Oil 7:

$$CH_3—(OEt, OPr)_{n'}—(OPr)_{n''}—OH$$

[polymer having a methyl group at one end and a hydroxyl group at the other end, in which a random copolymer chain of ethylene oxide and propylene oxide and a propylene oxide homopolymer chain are bonded in the order stated from the methyl group side,
number average molecular weight: 1200, $M_w/M_n$: 1.1, α=10 [mol %], β<5 [mol %], γ=10 [mol %]]

Base Oil 8:

$$\begin{array}{l} CH_2—(OCH_2CH_2)_{n'}—[OCH(CH_3)CH_2]_{n''}—OH \\ | \\ CH—(OCH_2CH_2)_{n'}—[OCH(CH_3)CH_2]_{n''}—OH \\ | \\ CH_2—(OCH_2CH_2)_{n'}—[OCH(CH_3)CH_2]_{n''}—OH \end{array}$$

[polymer in which a block copolymer chain of ethylene oxide and propylene oxide is bonded to each of three hydroxyl groups of glycerol,
number average molecular weight: 1200, $M_w/M_n$: 1.1, α=10 [mol %], β<5 [mol %], γ=10 [mol %]]

Base Oil 9:

$$CH_3—(OEt, OPr)_{n'}—(OEt)_{n''}—OH$$

[copolymer having a methyl group at one end and a hydroxyl group at the other end, in which a random copolymer chain of ethylene oxide and propylene oxide and an ethylene oxide homopolymer chain are bonded in the order stated from the methyl group side,
number average molecular weight: 1200, $M_w/M_n$: 1.1, α=10 [mol %], β>95 [mol %], γ=10 [mol %]]

Base Oil 10:

$$CH_3—(OPr)_{n'}—(OEt)_{n''}—OH$$

[ethylene oxide-propylene oxide block copolymer having a methyl group at one end and a hydroxyl group at the other end, number average molecular weight: 1200, $M_w/M_n$: 1.1, α=10 [mol %], β>95 [mol %], γ=10 [mol %]]

Base Oil 11: naphthene based mineral oil

Base Oil 12: poly(α-olefin)

The kinematic viscosities at 40° C. and at 100° C. and the total acid values of the above-stated base oils 1 to 12 are presented in Table 1.

The following tests were then conducted for each of the above sample oils.

(Refrigerant Miscibility Test 1)

In accordance with the "Refrigerant Miscibility Testing Method" of JIS-K-2211 "Refrigerating Machine oils," 3 g of each sample oil was blended with 2 g of the $CO_2$ refrigerant and a temperature range in which the refrigerant and the sample oil became miscible with each other, was measured. The results obtained are presented in Table 1. In this test the lower limit of the measurement temperature was −55° C. and in Table 1 "<−55 to +30" means that the sample oil and the $CO_2$ refrigerant were miscible with each other in the temperature range from the lower limit of measurement temperature to 30° C.

(Refrigerant Miscibility Test 2)

The $CO_2$ refrigerant and each sample oil were confined in the total amount of 5 g in a pressure glass container having the internal volume of 10 ml, and a state (miscible or separate) of the mixture at the cooling temperature of −30° C. was visually observed. This test was carried out in such a manner that the test was started from the refrigerating machine oil content of 1% by weight ($CO_2$ refrigerant: 4.95 g and sample oil 0.05 g) and the percentage of the sample oil was gradually increased while keeping the total amount of the $CO_2$ refrigerant and the sample oil at the fixed value (5.00 g), or in such a way that the test was started from the refrigerating machine oil content of 90% by weight ($CO_2$ refrigerant: 0.50 g and sample oil 4.50 g) and the percentage of the $CO_2$ refrigerant was gradually increased while keeping the total amount of the $CO_2$ refrigerant and sample oil at the fixed value (5.00 g). Determined by the test was a composition range where the mixture of the $CO_2$ refrigerant and sample oil became separate. The results obtained are presented in Table 1. In Table 1, "miscible" means that the mixture was not separated even with variation in the mixing ratio of the $CO_2$ refrigerant and sample oil, and "<1" as the lower limit of the composition range means that the mixture was already separated at the sample oil concentration of 1% by weight.

(Refrigerant Miscibility Test 3)

Figure 3:
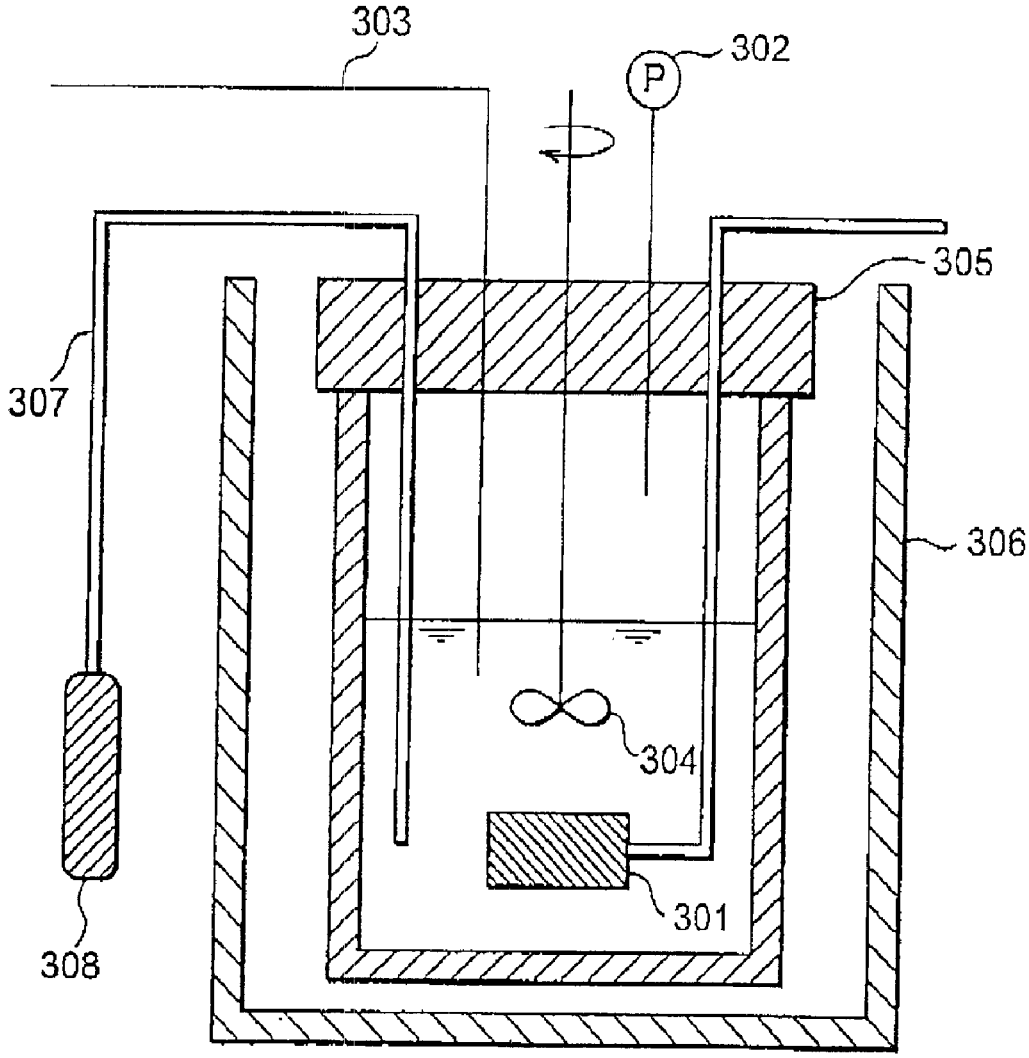
FIG. 3 is a schematic structural view to show a refrigerant solubility measuring system used in Examples.

Using a refrigerant solubility measuring system shown in FIG. 3, the solubility of the $CO_2$ refrigerant into each sample oil was measured under the condition where the mixture of the $CO_2$ refrigerant and the sample oil became separated.

The system shown in FIG. 3 is provided with a pressure vessel 305 (made of stainless steel and having the internal volume of 200 ml) equipped with a viscometer 301, a pressure gage 302, a thermocouple 303, and an agitator 304; a thermostatic bath 306 for controlling the temperature in the pressure vessel 305; and a sampling cylinder 308 having a valve and connected through a passage 307 to the pressure vessel 305. The sampling cylinder 308 is detachable from the passage 307, and the sampling cylinder 308 is constructed in such structure that in measurement the weight thereof can be measured after the interior has been evacuated to a vacuum or after a mixture of the $CO_2$ refrigerant and sample oil has been sampled. The thermocouple 303 and thermostatic bath 306 are electrically connected each to a temperature controller (not shown), and the system is configured so as to be able to control the temperature of the sample oil or the mixture in such a way as to send a data signal concerning the temperature of the sample oil (or the mixture of the $CO_2$ refrigerant and sample oil) from the thermocouple 303 to the temperature controller and send a control signal from the temperature controller to the thermostatic bath 306. Further, the viscometer 301 is electrically connected to an information processor (not shown), and the system is configured so as to be able to measure the viscosity under a prescribed condition in such a way as to send measured data about the viscosity of liquid in the pressure vessel 305 from the viscometer 301 to the information processor.

In this test, 30 g of each sample oil was first charged into the pressure vessel 305, the interior of the vessel was then evacuated to a vacuum, thereafter 70 g of the $CO_2$ refrigerant was introduced into the vessel, and the mixture of the $CO_2$ refrigerant and the sample oil was kept at −30° C. for two hours while being agitated by the agitator 304. After that, the agitation was terminated and the mixture was kept still before the $CO_2$ refrigerant and sample oil became separated into two layers. Then the interior of the sampling cylinder 308 was evacuated to a vacuum and the mass $W_1$ thereof was measured. Thereafter, the sampling cylinder 308 was connected to the passage 307 and the sample oil layer was sampled into the sampling cylinder 308 by making use of a pressure difference between internal pressures of the pressure vessel 305 and the sampling cylinder 308.

For the sampling cylinder 308 after the above sampling, the mass $W_2$ thereof (the sum of the masses of the sample oil with dissolved refrigerant and the sampling cylinder 308) was measured. Further, the valve was opened and the cylinder was heated while being evacuated, thereby removing the $CO_2$ refrigerant dissolved in the sample oil. After that, the mass $W_3$ (the sum of masses of the sample oil and the sampling cylinder 308) was measured.

Using measured values obtained in this way, the solubility of the $CO_2$ refrigerant in each sample oil was calculated based on the following equation:

$$(\text{solubility of } CO_2 \text{ refrigerant [\% by mass]})=[(W_2-W_3)/(W_3-W_1)]\times 100.$$

The results obtained are presented in Table 1.

(Stability Test under Refrigerant Atmosphere)

An autoclave was charged with 50 g of each sample oil, 10 g of carbon dioxide, 10 ml of air (a reduced value under the atmospheric pressure), and a catalyst (iron wires, aluminum wires, and copper wires of 1.6 mm ϕ×50 mm three each) and sealed, thereafter heated to 175° C., and then retained for two weeks. After that, carbon dioxide was removed from the sample oil, the appearance of the sample oil and the appearance of the catalyst were observed, and the total acid value of the sample oil was measured. The results obtained are presented in Table 1.

(Oxidation Stability Test)

30 g of each sample oil was charged into a 50 ml beaker (radius of the bottom surface: 2 cm) and kept still at 70° C. for ten days. After that, the total acid value of the sample oil was measured The results are presented in Table 1.

TABLE 1

| | Sample oils | Kinematic viscosity [$mm^2/s$] 100° C. | Kinematic viscosity [$mm^2/s$] 40° C. | Total acid value [mgKOH/g] | Pour point [° C.] | Miscibility test 1 (Miscible temperature range) [° C.] | Miscibility test 2 (Composition range of phase separation) [% by mass] | Miscibility test 3 (Solubility) [% by mass] | Stability test under refrigerant atmosphere: Oil appearance | Stability test under refrigerant atmosphere: Catalyst appearance | Stability test under refrigerant atmosphere: Total acid value [mgKOH/g] | Oxidation stability test Total acid value [mgKOH/g] |
|---|---|---|---|---|---|---|---|---|---|---|---|---|
| Example 1 | Base oil 1 | 5 | 19 | 0.01 | <−45 | <−55~+30 | Miscible | Miscible | No change | No change | 0.01 | 0.05 |
| Example 2 | Base oil 2 | 5 | 21 | 0.01 | <−45 | <−55~+30 | Miscible | Miscible | No change | No change | 0.01 | 0.05 |
| Example 3 | Base oil 3 | 10 | 52 | 0.01 | <−45 | <−55~+30 | 11~63 | 170 | No change | No change | 0.01 | 0.05 |
| Example 4 | Base oil 4 | 10 | 51 | 0.01 | <−45 | <−55~+30 | 10~62 | 163 | No change | No change | 0.01 | 0.05 |
| Example 5 | Base oil 5 | 10 | 49 | 0.01 | <−45 | <−55~+30 | 5~53 | 113 | No change | No change | 0.01 | 0.05 |
| Example 6 | Base oil 6 | 20 | 104 | 0.01 | <−45 | <−55~+30 | 2~45 | 82 | No change | No change | 0.01 | 0.05 |
| Example 7 | Base oil 7 | 10 | 52 | 0.01 | <−45 | <−55~+30 | 11~63 | 170 | No change | No change | 0.01 | 0.05 |
| Example 8 | Base oil 8 | 13 | 100 | 0.01 | <−45 | <−55~+30 | Miscible | Miscible | No change | No change | 0.01 | 0.05 |
| Comparative Example 1 | Base oil 9 | 10 | 52 | 0.01 | <−45 | <−55~+30 | 11~62 | 163 | No change | Fe: partially discolored | 0.13 | 0.18 |
| Comparative Example 2 | Base oil 10 | 10 | 52 | 0.01 | <−45 | <−55~+30 | 11~61 | 156 | No change | Fe: partially discolored | 0.11 | 0.15 |
| Comparative Example 3 | Base oil 11 | 4 | 22 | 0.01 | −35 | Immiscible | 0~15 | 18 | No change | Fe: partially discolored | 0.02 | 0.03 |
| Comparative Example 4 | Base oil 12 | 10 | 65 | 0.01 | <−45 | Immiscible | 0~13 | 15 | No change | Fe: partially discolored | 0.02 | 0.03 |

As apparent from the results presented in Table 1, it was verified that the sample oils of Examples 1 to 8 being the refrigerating machine oils of the present invention demonstrated satisfactorily high miscibility at either high or low ratios to the $CO_2$ refrigerant and that even if the $CO_2$ refrigerant and sample oil were separated into two layers a sufficient amount of the $CO_2$ refrigerant was dissolved in the sample oil. Further, the sample oils of Examples 1 to 8 were excellent in all the properties of lubricity, low-temperature fluidity, and stability in a good balance.

In contrast to it, the sample oils of Comparative Examples 1 and 2 using the polyalkylene glycol compound except for the polyalkylene glycol of the present invention were inferior in either of the refrigerant miscibility, stability under the refrigerant atmosphere, and oxidation stability when used along with the $CO_2$ refrigerant.

As described above, the refrigerating machine oil according to the present invention contains the specific polyalkylene glycol, whereby it can attain the lubricity, refrigerant miscibility, low-temperature fluidity, and safety in a good balance. Accordingly, the refrigerating machine oil of the invention can fully demonstrate its performance in diverse applications of carbon dioxide as a refrigerant for refrigerating machines.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A refrigerating machine oil for a carbon dioxide refrigerant, comprising polyalkylene glycol represented by the following general formula (1):

$$R^1\{—(OR^2)_n—OH\}_m \quad (1)$$

wherein a number average molecular weight of said polyalkylene glycol is not less than 500 nor more than 5000, wherein a rate of ethylene group among said alkylene group in said polyalkylene glycol is more than 0 and not more than 80 mol %, and wherein a rate of molecules in which the alkylene group bonded to a terminal hydroxyl group in said polyalkylene glycol is an ethylene group, is not more than 20 mol %, wherein said polyalkylene glycol has a first polymer chain selected from an ethylene oxide homopolymer chain and a copolymer chain of ethylene oxide and one or more alkylene oxides except for ethylene oxide, and a second polymer chain of one or more alkylene oxides except for ethylene oxide, the one end of the first polymer chain being bonded to $R^1$, the other end of the first polymer chain being bonded to one end of the second polymer chain; and the other end of the second polymer chain being bonded to a terminal hydroxyl group.

2. The refrigerating machine oil according to claim 1, wherein a kinematic viscosity at 100° C. of said polyalkylene glycol falls between and 20 $mm^2/s$.

3. A fluid composition for refrigerating machines, comprising the refrigerating machine oil for the carbon dioxide refrigerant as set forth in claim 1 or 2, and the carbon dioxide refrigerant.

* * * * *

UNITED STATES PATENT AND TRADEMARK OFFICE

CERTIFICATE OF CORRECTION

PATENT NO. : 6,936,576 B2
DATED : August 30, 2005
INVENTOR(S) : Tomomasa Ohsumi et al.

It is certified that error appears in the above-identified patent and that said Letters Patent is hereby corrected as shown below:

Column 22,
Line 13, insert -- 5 -- before “and”.

Signed and Sealed this

Twenty-ninth Day of November, 2005

JON W. DUDAS
*Director of the United States Patent and Trademark Office*